US007765621B2

(12) United States Patent
Lardeau

(10) Patent No.: US 7,765,621 B2
(45) Date of Patent: Aug. 3, 2010

(54) REMOVABLE MODULAR PADDING FOR PROTECTIVE HELMET AND HELMET EQUIPPED THEREWITH

(75) Inventor: Frédéric Lardeau, Lyons (FR)

(73) Assignee: MSA Gallet, Chatillon sur Shalaronne (FR)

( * ) Notice: Subject to any disclaimer, the term of this patent is extended or adjusted under 35 U.S.C. 154(b) by 1084 days.

(21) Appl. No.: 10/538,810

(22) PCT Filed: Dec. 10, 2003

(86) PCT No.: PCT/FR03/03645

§ 371 (c)(1),
(2), (4) Date: Mar. 13, 2006

(87) PCT Pub. No.: WO2004/062411

PCT Pub. Date: Jul. 29, 2004

(65) Prior Publication Data

US 2006/0162054 A1 Jul. 27, 2006

(30) Foreign Application Priority Data

Dec. 13, 2002 (FR) ..... 02 15899

(51) Int. Cl.
*A42B 1/06* (2006.01)

(52) U.S. Cl. ..... 2/414; 2/411; 2/410

(58) Field of Classification Search ..... 2/410–414, 2/422

See application file for complete search history.

(56) References Cited

U.S. PATENT DOCUMENTS

| | | | | |
|---|---|---|---|---|
| 3,843,970 A | 10/1974 | Marietta et al. | ..... | 2/3 R |
| 4,766,610 A * | 8/1988 | Mattes | ..... | 2/414 |
| 4,916,759 A | 4/1990 | Arai | ..... | 2/414 |
| 5,003,636 A | 4/1991 | Marostica | ..... | 2/145 |
| 5,655,227 A * | 8/1997 | Sundberg et al. | ..... | 2/414 |
| 5,765,234 A | 6/1998 | Petzl | ..... | 2/417 |
| 5,930,840 A * | 8/1999 | Arai | ..... | 2/411 |
| 6,279,172 B1 * | 8/2001 | Epperson et al. | ..... | 2/410 |
| 6,357,054 B1 * | 3/2002 | Bainbridge et al. | ..... | 2/455 |
| 2002/0073479 A1 * | 6/2002 | Epperson et al. | ..... | 2/410 |

FOREIGN PATENT DOCUMENTS

| | | |
|---|---|---|
| EP | 0 346 608 | 12/1989 |
| EP | 0 792 592 | 9/1997 |
| FR | 2 746 602 | 10/1997 |
| FR | 2793119 | 11/2000 |
| FR | 2804288 | 8/2001 |
| WO | WO 92/10952 | 7/1992 |
| WO | WO 94/22337 | 10/1994 |

* cited by examiner

*Primary Examiner*—Shaun R Hurley
*Assistant Examiner*—Andrew W Sutton
(74) *Attorney, Agent, or Firm*—Fay Sharpe LLP

(57) ABSTRACT

Supplementary padding (8), for a protective helmet (1) includes a T-shaped envelope (9) designed to be removably affixed inside the helmet. The envelope is made of a flexible material and defines pockets for receiving supplemental padding elements (10*a*, 10*b*, 10*c*, 10*d*), optionally made of synthetic foam. The envelope includes at least one opening for inserting the supplemental padding elements into said envelope and a self-gripping textile (21*a*, 21*b*, 21*c*, 21*d*) for releasably adhering the envelope to lining (7) of the helmet.

5 Claims, 5 Drawing Sheets

REMOVABLE MODULAR PADDING FOR PROTECTIVE HELMET AND HELMET EQUIPPED THEREWITH

BACKGROUND OF THE INVENTION

The present invention relates to padding for protective helmets, and more particularly a removable supplementary padding allowing an adaptation of the helmet volume to the form and dimensions of the user's head. The invention also relates to helmets equipped with the padding.

One already knows protective helmets used in various fields and which are worn by a variety of diverse users such as cyclists, motorcyclists, firemen, skiers, and others, such as airplane or helicopter pilots.

All the current helmets, whatever their use, include an external rigid shell having a generally spherical shape, and whose cavity is thus formed and includes elements of protective padding and comfort intended to encase and protect the head of the user, while rendering the wearing of the helmet comfortable.

The protective helmet must have appropriate interior dimensions and be in conformity with the dimensions, form, and volume of the head of the user. Helmets being industrially-made products, it is thus not possible, taking into account the diversity of the wearers' heads, to industrially manufacture specific helmets adapted to each user.

Thus, the helmets are marketed according to various sizes, but others include systems of adjustment in order to adjust to and be regulated by the desired dimensions and volume to adapt to the user.

U.S. Pat. No. 5,765,234 shows a helmet whose adjustment includes several adjustable knobs which cover the interior of the helmet, which are to be in contact with the head of the user. It was understood that this device is not at all satisfactory, because the contacts with the interior of the helmet are specific and render the wearing of the helmet particularly uncomfortable, and that, of course, affects its safety.

One knows also the device shown in the American patent U.S. Pat. No. 3,082,427 includes a deformable internal cap made of an adjustable mesh. This device forms part of an obsolete technology, and the helmet is meant, to some extent, to be floating, and is thus uncomfortable and a little unsafe.

U.S. Pat. No. 5,003,636 discloses an adjustment including a plurality of inflatable compartments. This concept, even if it appears, at first sight, alluring, is a difficult technology to implement and is not very reliable because the inflatable cells are constantly damaged.

All of the former systems thus present a certain number of disadvantages and those being, in particular, expense, a lack of reliability, discomfort, and a lack of practicality.

SUMMARY OF THE INVENTION

The present invention thus wants to solve these disadvantages by proposing a modular and modifiable supplementary padding, constituted by a removable envelope into which can be introduced one or more supplementary elements of padding, the aforementioned envelope being advantageously affixed in a removable way to the interior of the helmet. The padding is between the helmet itself, with its resident padding and lining, and the cranium of the user.

Thus, according to the invention, padding for a protective helmet is a supplementary padding, including an envelope intended to be attached inside the helmet; the aforementioned envelope being made out of flexible material and including at least a supplementary element of padding made out of synthetic foam, while the envelope includes at least one opening allowing the introduction of the supplementary element into the aforementioned envelope. As well as including the means of attaching the padding inside the helmet.

According to a supplementary characteristic, the supplementary padding is intended to be attached inside the helmet in a removable way by means of removable attachments, for example, using one or more bands of auto-gripping textile, such as the type with hooks.

According to a preferred embodiment, the supplementary padding is an envelope having the general shape of a 'T', which includes a longitudinal central branch, whose front end is elongated laterally towards the left by a left side branch and towards the right-hand side by a right side branch.

According to supplementary characteristics of the preferred embodiment, the supplementary padding is made of a lower wall, connected by its edge to an upper wall, the aforementioned walls being made of a soft material such as, for example, fabric, which is able to be deformed, while the longitudinal central branch includes, on its upper wall in contact with the lining fabric, an opening to constitute a longitudinal central pocket into which can be introduced a supplementary element of central padding, while the left side branch includes, on its upper wall in contact with the lining fabric, an opening to constitute a longitudinal central pocket, into which can be introduced a supplementary element of central padding, the longitudinal right side branch including, on its upper wall, an opening to constitute a longitudinal central pocket, into which can be introduced a supplementary element of central padding.

According to another characteristic, the central junction of the three branches of the envelope includes, on its upper wall, an opening to constitute a longitudinal central pocket, into which can be introduced a supplementary element of central padding.

According to another characteristic, it is the higher wall of the envelope which includes at least one band of self-gripping textile of the type with hooks.

The invention also relates to the protective helmet equipped with supplementary padding, the aforementioned helmet being, for example, a rigid primary shell, including an internal padding commonly called "calotin", made out of rigid synthetic foam such as expanded polystyrene or of polyurethane foam, and includes, in addition, an interior trim including a layer of foam ensuring the comfort of the helmet and a comfortable lining fabric intended, in particular, its interior decoration, while the removable supplementary padding is attached to the comfortable lining fabric.

Let us add that, according to the preferred embodiment, the central junction of removable padding is affixed on the frontal zone of the interior of the helmet, while the two side branches are affixed laterally in the area of the temples, and that the longitudinal central branch is affixed in the plane of symmetry which extends from the frontal zone backwards, for example, to the nape of the neck.

BRIEF DESCRIPTION OF THE DRAWINGS

Other characteristics and advantages of the invention will emerge from the description which follows, referring to the annexed drawings which are given only by way of nonrestrictive examples.

FIG. 1 is a prospective view of a helmet without supplementary padding, while

FIG. 6*a* is a cross-section of A-A of the FIG. 6, while

DETAILED DESCRIPTION OF THE PREFERRED EMBODIMENTS

Figure 1:
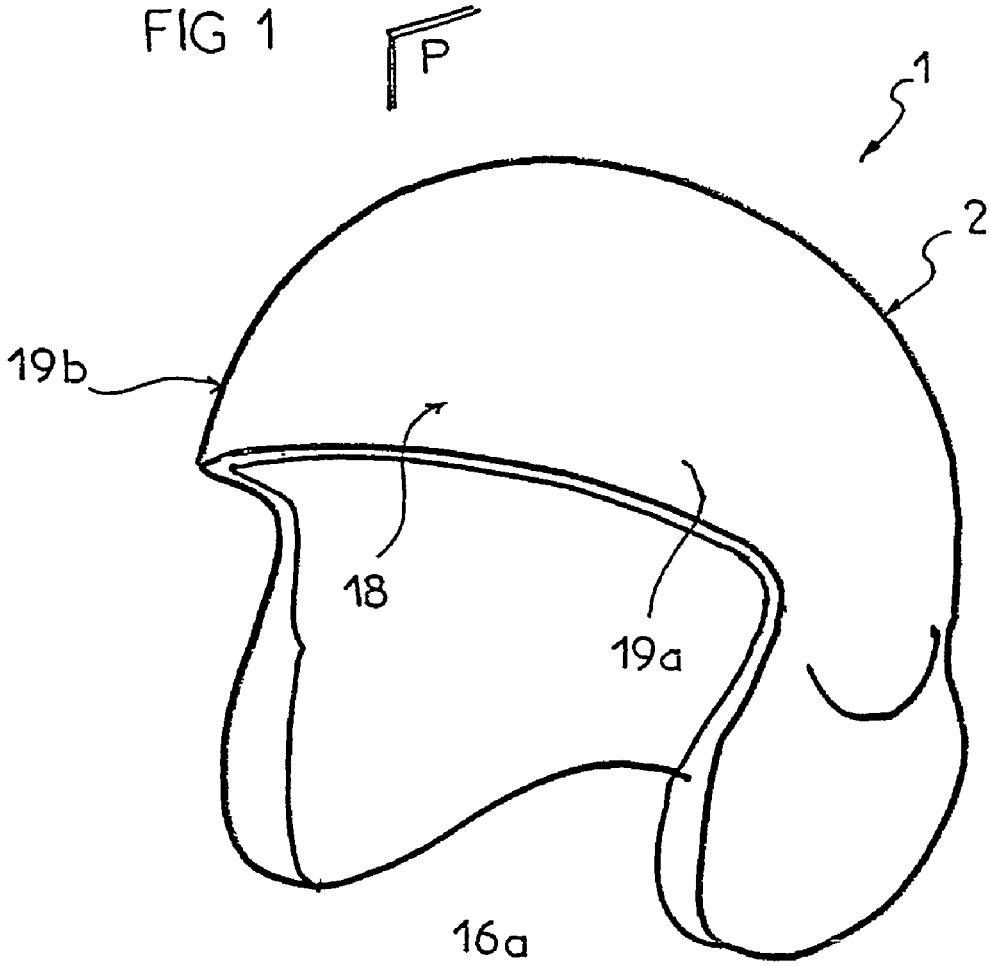
Figure 1A:
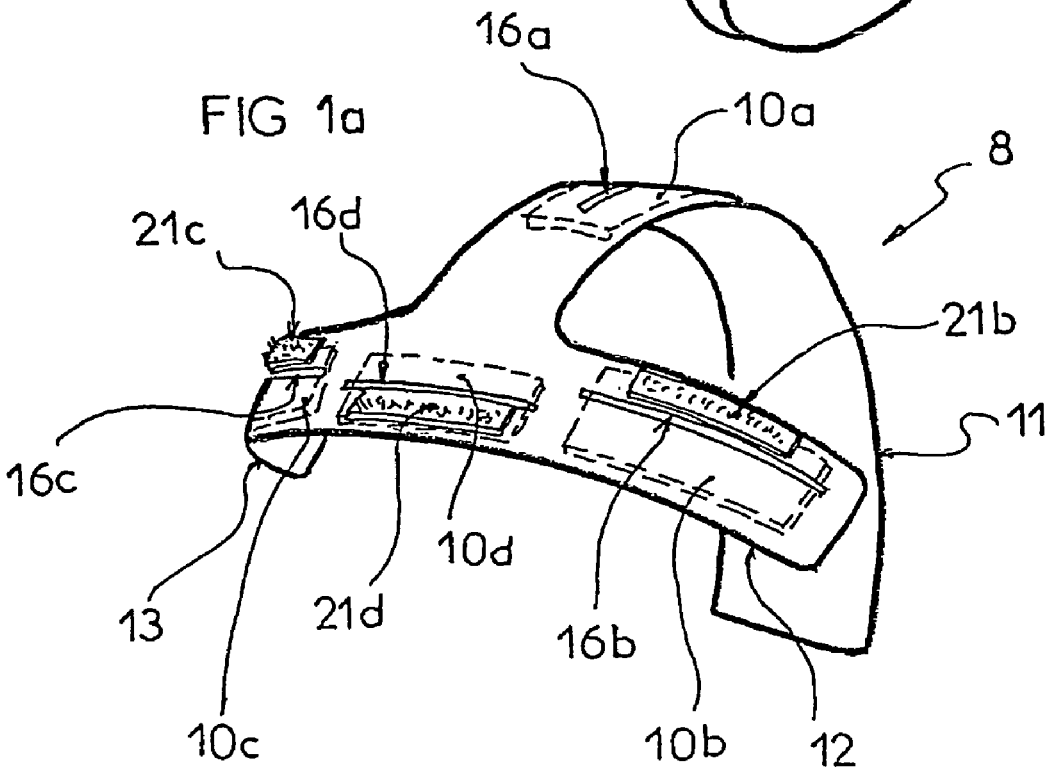
FIG. 1*a* shows the padding right before its installation in the helmet.
Figure 2:
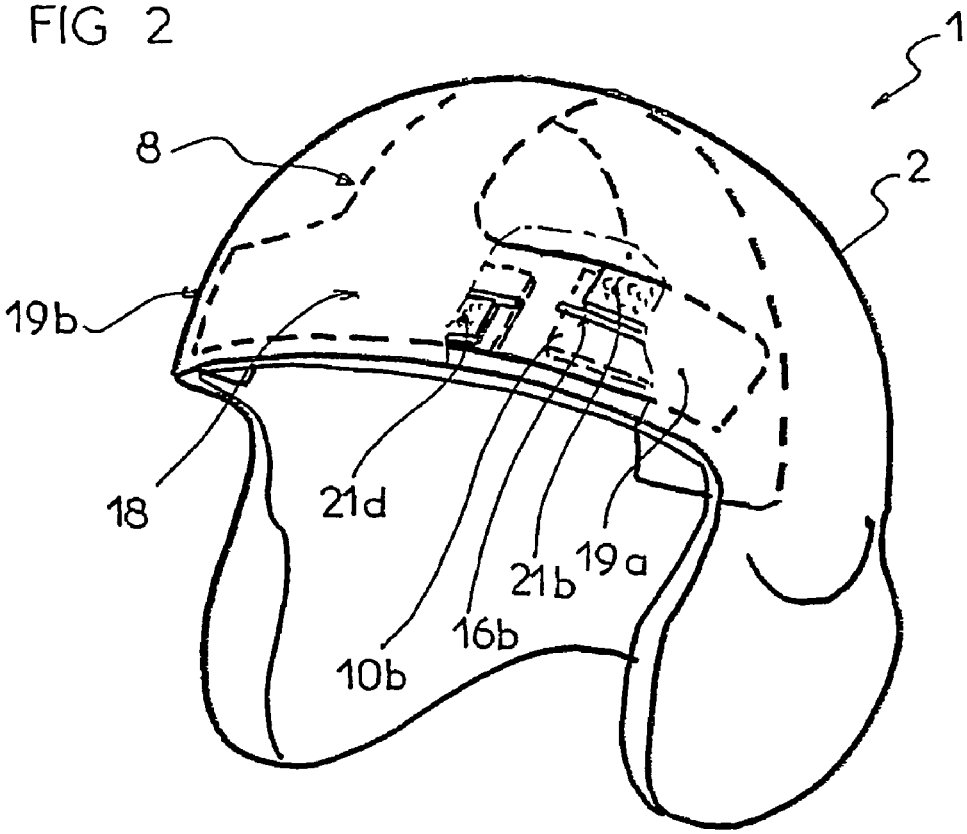
FIG. 2 is a prospective view of a helmet, equipped with supplementary padding, with a part of the aforementioned padding shown in phantom.
Figure 3:
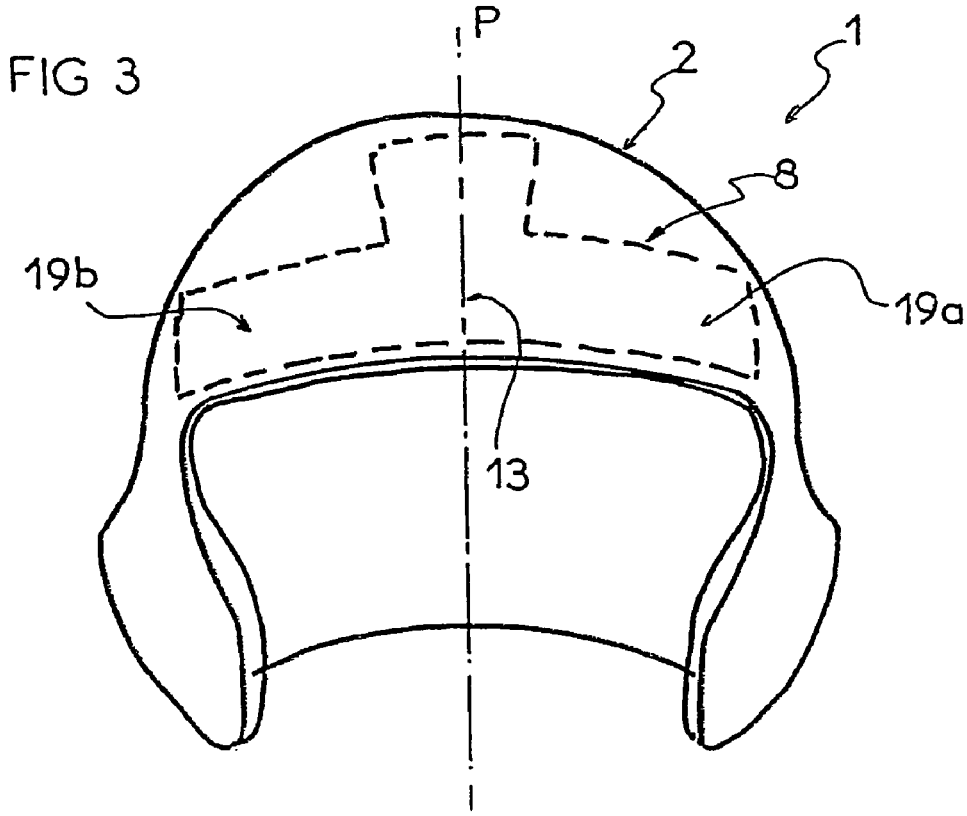
FIG. 3 is a front view of the helmet equipped with its supplementary padding.
Figure 4A:
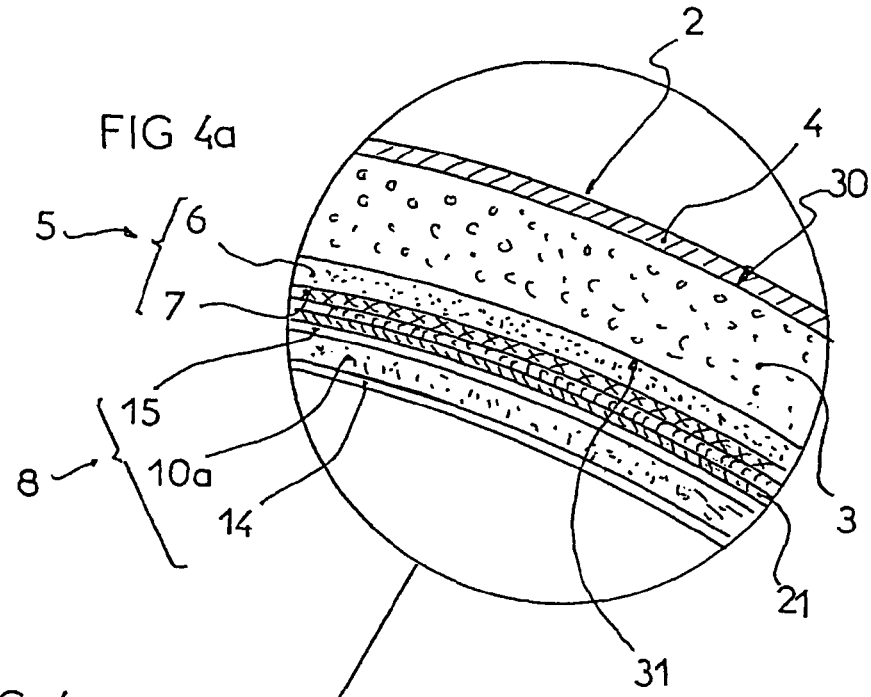
FIG. 4 is a side view of the helmet equipped with its removable padding, while the FIG. 4*a* is a sectional view, in enlarged scale, revealing the succession of layers laid out inside the shell of the helmet, including the layers of supplementary padding.
Figure 4:
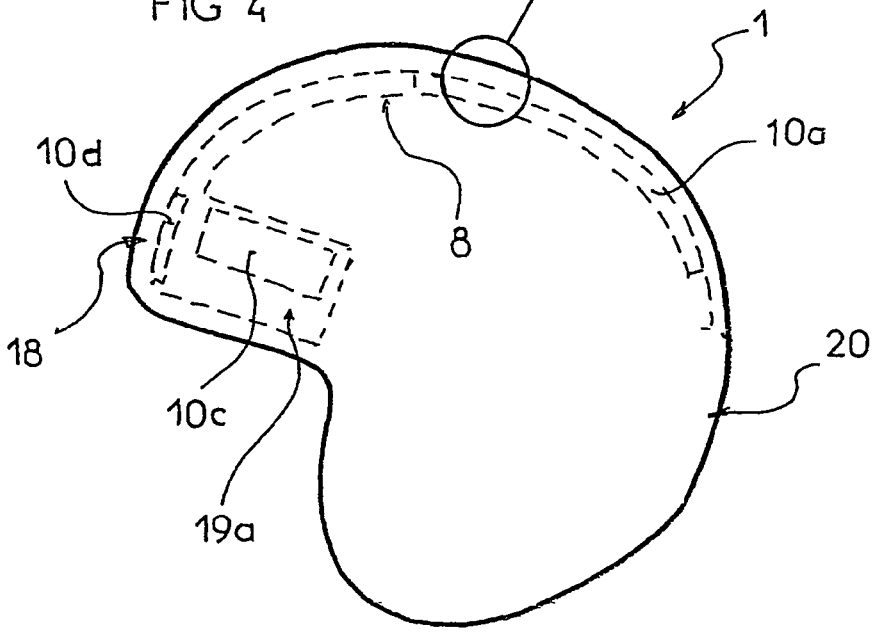
Figure 5:
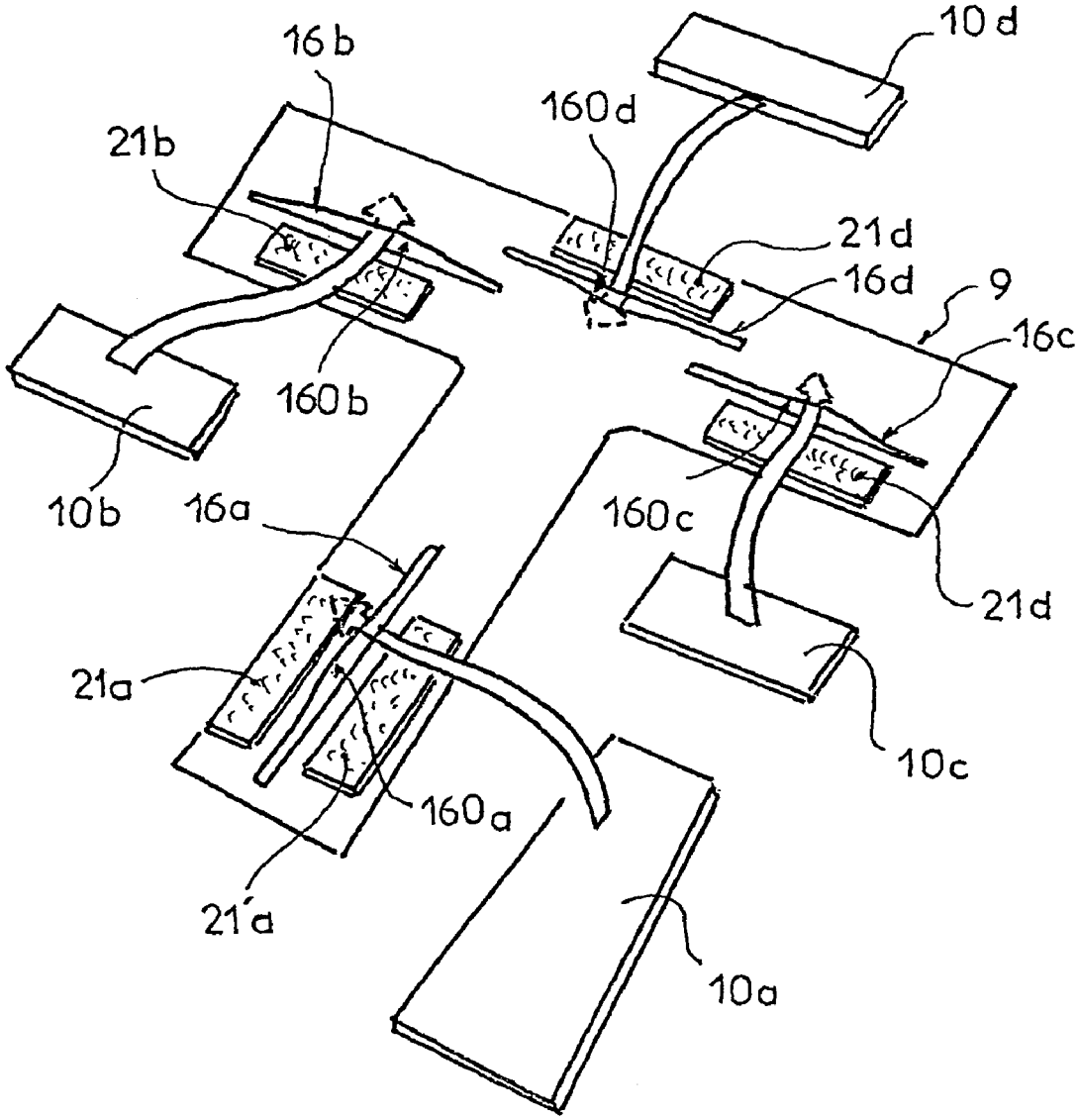
FIG. 5 is a schematic view, in perspective, of the supplementary padding before its installation.
Figure 6:
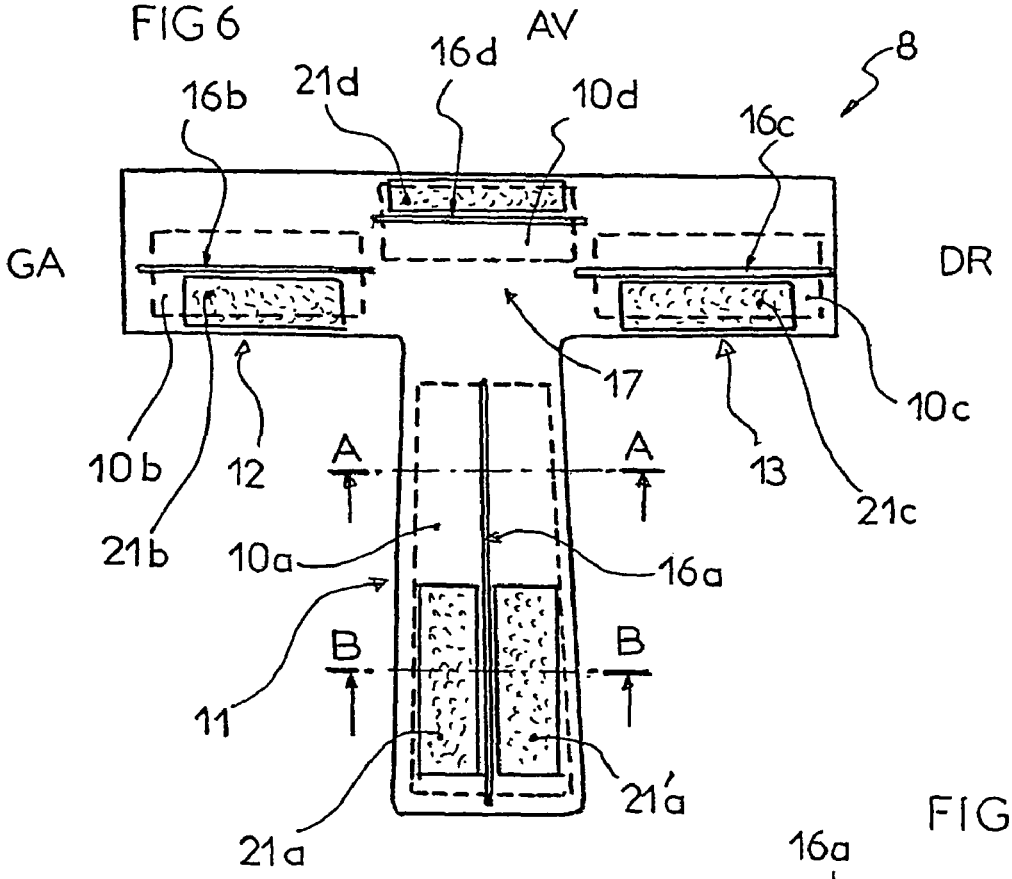
FIG. 6 is a top view of the supplementary padding laid flat, equipped with its supplementary elements of padding.
Figure 6A:
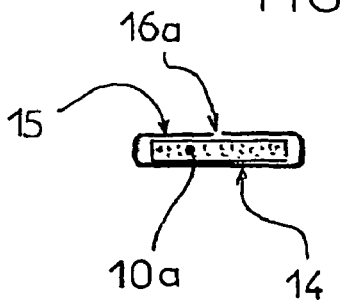
Figure 6B:
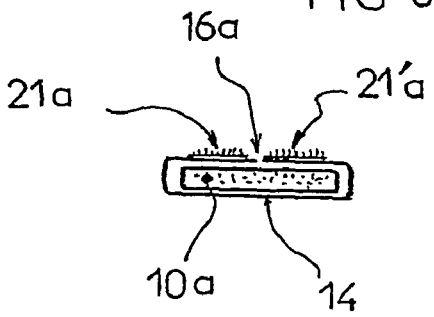
FIG. 6*b* is a cross-section of B-B of FIG. 6.

The protective helmet (1), intended to be equipped with the padding of the invention, represented by way of examples in FIGS. 1 to 4, is, for example, a helmet for airplane pilots. It presents a longitudinal plane of general symmetry (P) which includes in a known way a principal external shell (2) including a resident internal padding, commonly called "calotin" (3), and an internal lining (5).

The principal external shell (2) is made up of an appreciably spherical wall (4) along a general vertical plane of symmetry (P) which is advantageously made of composite material including a stack of layers made of reinforcing fibers, impregnated and bound by a resin matrix. The fibers can be made of carbon or polyethylene, nylon, aramide, glass fibers, while the matrix can be a resin of the thermal hardening or thermoplastic type. Of course, the shell could be in any other material such as, for example, steel.

The resident internal padding (3) includes a layer of rigid synthetic foam such as foam of expanded polystyrene or polyurethane or other types of polymer. The resident internal padding (3) ensures the protection of the user's cranium by impact damping and thus includes an enveloping wall, for the cranium on the upper surface (30) conforms in large part to the interior shape of the interior surface of the shell, while its lower surface (31) conforms to the shape of cranium.

The resident padding (3) thus ensures the protection of the cranium, while it is over laid with an interior trim (5), including a layer of foam (6) ensuring the comfort of the helmet, and a comfortable lining fabric (7), in particular intended, for interior decoration, and attachment of the padding.

The supplementary padding, which is advantageously removable (8), is formed of an envelope (9) made of deformable material, such as fabric or the like, inside of which is at least one supplementary element of padding (10) made of a similar material or foam element. In addition, the envelope (9) includes at least one opening allowing the introduction and/or withdrawal and/or replacement of the supplementary element. Moreover, the means of attachment are designed to affix the supplementary padding (8) inside the shell (2), and more precisely to affix the removable padding onto the comfortable lining fabric (7).

In the preferred embodiment, the removable supplementary padding (8) is an envelope (9) having the general form of a 'T', which includes a longitudinal central branch (11), whose frontal end (AV) is prolonged laterally towards the left (GA) by a left side branch (12), and towards the right (DR) by a right side branch (13).

The removable supplementary padding (8), made up of its various branches (11,12, 13), is an envelope (9) formed of a lower wall (14), connected by its edge to an upper wall (15), the aforementioned walls being made of a soft material such as, for example, fabric, able to be deformed and installed inside the helmet. Let us specify that the upper wall (15) of the envelope (9) is in contact with the interior of the helmet and more exactly with the comfortable lining fabric (7), while the lower wall (14) is in contact with the head of the user.

One will note that the upper wall (15) includes at least one opening (16*a*, 16*b*, 16*c*, 16*d*) allowing the introduction into the envelope (9) of at least one supplementary element of padding (10*a*, 10*b*, 10th, 10*d*), advantageously made out of synthetic foam.

According to the preferred embodiment, the envelope includes four openings (16*a*, 16*b*, 16*c*, 16*d*) allowing the introduction of four supplementary elements of padding (10*a*, 10*b*, 10*c*, 10*d*).

Thus, the longitudinal central branch (11) includes, on its upper wall (15) in contact with the lining fabric (7), an opening (16*a*) to access a longitudinal central pocket (160*a*) into which can be introduced a supplementary element of central padding (10*a*).

In addition, the left side branch (12) includes, on its upper wall (15) in contact with the lining fabric (7), an opening (16*b*) to constitute a central longitudinal pocket (160*b*), into which can be introduced a supplementary element of left side padding (10*b*).

As well, the longitudinal right side branch (13) includes, on its upper wall, an opening (16*c*) to access a longitudinal central pocket (160*c*), into which can be introduced a supplementary element of right side padding (10*c*).

In addition, the central junction (17) of the three branches (11, 12, 13) includes, advantageously, on its upper wall, an opening (16*d*) to access a longitudinal central pocket (160*d*), into which can be introduced a supplementary element of forward padding (10*d*).

Let us add that the supplementary element of central padding (10*a*) advantageously has the shape of a trapezoid whose small base (22) is in front and the large base (23) in the back, in order to be broader across the back of the user's cranium.

The various openings (16*a*, 16*b*, 16*c*, 16*d*) are, for example, simple slits made in the upper wall (15) of the envelope (9).

The envelope (9) includes removable padding (8) with its supplementary elements of padding (10*a*, 10*b*, 10th, 10*d*) which is intended to affix itself inside the helmet onto the decorative fabric (7) of the internal lining (5). Thus, the central junction (17) is affixed on the frontal zone (18) of the interior of the helmet, the two side branches (12,13) are affixed laterally in the zone of the temples, respectively (19*a*, 19*b*), while the longitudinal central branch (11) is affixed in the symmetry plane which extends from the frontal zone (18) backwards, for example, to the nape of the neck (20).

To retain the removable padding (8) inside the helmet, a means of attachment is envisioned, the latter allowing, for example, to affix to the upper wall (15) of the envelope (9) the on decorative fabric (7). These means are, for example, self-gripping. Thus, it is envisaged between the interior wall of the helmet and, more precisely, between the lining fabric (7) and the upper wall (15), an attachment out of a gripping textile of the type marketed under the "Velcro" trademark, formed by a band of textile (21) of the type with hooks, intended to cooperate with the velvet of the lining fabric (7). Thus, the upper wall (15) of the envelope for the removable padding (8) includes, for example, five bands of gripping textile of the type with hooks (21*a*, 21'*a*, 21*b*, 21*c*, 21*d*), respectively attached on the longitudinal central branch (11), the left side branch (12), the right side branch (13) and the junction (17).

It was understood that, thanks to the openings (16*a*, 16*b*, 16*c*, 16*d*), the user can remove the supplementary padding elements (10*a*, 10*b*, 10*c*, 10*d*) which are removable to, if required, replace them with other removable supplementary elements of padding, which could be different, such as, for example, a different thickness, or a different matter, namely, harder or more flexible, to even a different form.

Thus, a given envelope can correspond to several different types of supplementary padding elements, so that the user can choose the supplementary padding elements allowing him to obtain an optimal adaptation of the interior volume of the helmet, and thus personalize his helmet.

It goes without saying that the supplementary padding which with the form of a perfect 'T' in the preferred embodiment proposed by way of example, could have all other forms to adapt to the configuration of the interior of the helmet in which it is intended to be mounted. Thus, and for example, two side branches of the T (12,13) which are in line with each other in the illustrations could, for example, be convergent or divergent. Also let us add that, in the shown illustrations, the two side branches (12, 13) are perpendicular but it could, of course, be arranged differently, and have all other forms adapted to the helmet into which supplementary padding is destined.

Of course, the invention is not limited to the preferred embodiment described and represented by way of examples, but it includes also all the technical equivalents as well as their combinations.

The invention claimed is:

1. A padding for a protective helmet, including:

an envelope configured to be attached inside the helmet, the envelope being made of flexible material;

at least one supplementary padding element received in the envelope; the envelope including at least one opening allowing introduction and removal of the supplementary padding element into and from the envelope;

wherein:

the envelope has a general form of a 'T', which includes a longitudinal central branch whose front end extends laterally towards the left to define a left side branch and towards the right to define a right side branch;

the envelope includes a lower wall connected by its edge to an upper wall, the walls being made of a soft material which is able to be deformed;

the at least one supplemental padding element is received in the branches of the envelope; and the at least one supplemental padding element includes attachment means affixed in a removable way to the envelope; and wherein:

the longitudinal central branch includes, on its upper wall which contacts a lining fabric of the helmet, an opening to access a longitudinal pocket into which can be introduced a supplementary padding element;

the left side branch includes, on its upper wall which contacts the lining fabric, an opening to access a pocket, into which can be introduced a supplementary padding element; and the right side branch includes, on its upper wall, an opening to access a pocket into which can be introduced a supplementary padding element.

2. A padding for the protective helmet, including:

an envelope configured to be attached inside the helmet, the envelope being made of flexible material;

at least one supplementary padding element received in the envelope; the envelope including at least one opening allowing introduction and removal of the supplementary padding element into and from the envelope; and wherein the envelope has a general form of a 'T', which includes a longitudinal central branch whose front end extends laterally towards the left to define a left side branch and towards the right to define a right side branch, the envelope includes a lower wall connected by its edge to an upper wall, the walls being made of a soft material which is able to be deformed, the at least one supplemental padding element is received in the branches of the envelope, and the at least one supplemental padding element includes attachment means affixed in a removable way to the envelope; and wherein:

the longitudinal central branch includes, on its upper wall which contacts a lining fabric of the helmet, an opening to access a longitudinal pocket into which can be introduced a supplementary padding element, the left side branch includes, on its upper wall which contacts the lining fabric, an opening to access a pocket, into which can be introduced a supplementary padding element, and the right side branch includes, on its upper wall, an opening to access a pocket into which can be introduced a supplementary padding element; and wherein a central junction of the three branches includes, on its upper wall, an opening to access a pocket, into which can be introduced a supplementary padding element.

3. The padding for the protective helmet according to claim 2, wherein the upper wall of the envelope includes at least a band of self-gripping textile of the type with hooks.

4. A protective helmet including:

a principal external shell including resident internal padding made out of rigid synthetic foam and a lining fabric; and the padding according to claim 1.

5. A protective helmet comprising:

a rigid shell which defines an interior cavity;

resident padding affixed to the shell in the interior cavity;

an envelope configured to be mounted inside the resident padding and be adapted to contact a user's head, the envelope being made of flexible fabric;

the envelope including a lower wall and an upper wall connected along at least one edge, the walls being made of a soft, deformable material, the upper wall contacting the lining fabric;

the envelope having a T-shape, which includes a longitudinal central branch and left and right side branches extending laterally outward from a front end of the longitudinal central branch, the envelope including at least one access opening to its interior;

a plurality of supplemental deformable padding elements configured to be inserted through the access opening into the interior of the branches of the envelope;

an attachment structure which removably attaches the supplemental deformable padding elements to the interior of the envelope such that the supplemental deformable padding elements adapt the helmet to a shape and volume of a user's head; and wherein:

the longitudinal central branch includes, on its upper wall which contacts the resilient padding, an opening to access a longitudinal pocket into which can be introduced one of the supplemental padding elements;

the left side branch includes, on its upper wall which contacts the resilient padding, an opening to access a pocket, into which can be introduced another of the supplemental padding elements; and the right side branch includes, on its upper wall which controls the resilient padding, an opening to access a pocket into which can be introduced another of the supplemental padding elements.

* * * * *

UNITED STATES PATENT AND TRADEMARK OFFICE

CERTIFICATE OF CORRECTION

PATENT NO. : 7,765,621 B2
APPLICATION NO. : 10/538810
DATED : August 3, 2010
INVENTOR(S) : F. Lardeau It is certified that error appears in the above-identified patent and that said Letters Patent is hereby corrected as shown below:

Title Page; should read;

(75) Frédéric Lardeau, Lyon (FR)

(73) MSA Gallet, Chatillon sur Chalaronne (FR)

Signed and Sealed this

Fourteenth Day of December, 2010

David J. Kappos

David J. Kappos
*Director of the United States Patent and Trademark Office*